US008919307B2

(12) United States Patent
Fernandez

(10) Patent No.: US 8,919,307 B2
(45) Date of Patent: Dec. 30, 2014

(54) VALVE TRAIN SYSTEM FOR PROVIDING CONTINUOUSLY VARIABLE VALVE LIFT

(71) Applicant: Delphi Technologies, Inc., Troy, MI (US)

(72) Inventor: Hermes A. Fernandez, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 102 days.

(21) Appl. No.: 13/857,272

(22) Filed: Apr. 5, 2013

(65) Prior Publication Data

US 2014/0299083 A1 Oct. 9, 2014

(51) Int. Cl.
*F01L 1/34* (2006.01)
*F01L 1/18* (2006.01)

(52) U.S. Cl.
CPC ..... *F01L 1/185* (2013.01)
USPC ..... 123/90.16; 123/90.39

(58) Field of Classification Search
USPC ..... 123/90.16, 90.39
See application file for complete search history.

(56) References Cited

U.S. PATENT DOCUMENTS

| | | | | |
|---|---|---|---|---|
| 5,937,809 | A | 8/1999 | Pierik et al. | |
| 6,422,187 | B2 | 7/2002 | Fischer et al. | |
| 6,868,811 | B2 | 3/2005 | Koro et al. | |
| 6,988,473 | B2 | 1/2006 | Rohe et al. | |
| 7,451,729 | B2 * | 11/2008 | Sugiura et al. | 123/90.16 |
| 7,836,863 | B2 | 11/2010 | Kwak et al. | |
| 8,113,158 | B2 | 2/2012 | Lancefield et al. | |
| 2007/0125330 | A1 | 6/2007 | Lee et al. | |
| 2011/0180028 | A1 | 7/2011 | Takemura et al. | |

* cited by examiner

*Primary Examiner* — Zelalem Eshete
(74) *Attorney, Agent, or Firm* — Thomas N. Twomey

(57) ABSTRACT

A valve train system includes a camshaft with a camshaft lobe that is rotatable about a camshaft axis. A control shaft is rotatable about a control shaft axis and includes an eccentric control shaft slot. An input rocker engages the camshaft lobe and has a rocker slot. An output rocker engages a valve actuation member which is engaged with a combustion valve. A rocker pivot shaft has a rocker pivot shaft axis and is fixed to the output rocker and extends through both the control shaft slot and the rocker slot. Rotation of the camshaft causes the input rocker and the output rocker to pivot about the rocker pivot shaft axis and rotation of the control shaft changes the magnitude that the input rocker and the output rocker pivot about the rocker pivot shaft axis and also changes the magnitude of opening the combustion valve.

23 Claims, 5 Drawing Sheets

VALVE TRAIN SYSTEM FOR PROVIDING CONTINUOUSLY VARIABLE VALVE LIFT

TECHNICAL FIELD OF INVENTION

The present invention relates to a valve train system for opening and closing a combustion valve of an internal combustion engine; more particularly to a valve train system which is able to continuously vary the magnitude of opening of the combustion valve.

BACKGROUND OF INVENTION

Internal combustion engines have historically employed valve train systems that open combustion valves a fixed amount and then return the combustion valve to a closed position. Combustion valves as discussed herein may be either intake valves that allow a charge of air or air and fuel into a combustion chamber of the internal combustion engine or exhaust valves that allow exhaust constituents to be expelled from the combustion chamber of internal combustion engine. More recently, valve train systems have been developed that allow combustion valves to be opened a varying amount in order to achieve desired engine operating characteristics, thereby meeting fuel economy needs, achieving desired engine performance, and reducing emissions. One such valve train system is known as a continuously variable valve lift (CVVL) system in which the magnitude of lift of the combustion valve can be varied to any desired amount between a minimum lift and a maximum lift.

An example of a CVVL system is shown in U.S. Pat. No. 6,988,473 to Rohe et al. In this example, the CVVL system varies the lift of the combustion valve; however, in doing so, the CVVL system also delays the timing during the engine cycle at which the combustion valve begins to open as the lift of the combustion valve is decreased. Delaying the opening of the combustion valve may be acceptable in some systems but may be undesirable in other systems. The arrangement of U.S. Pat. No. 6,988,473 is commonly referred to as a lost motion arrangement because when the CVVL system is controlled to produce less than maximum lift of the combustion valve, a portion of rotation of the mechanism is not transferred to the combustion valve and is used only to compress a lost motion spring.

Another example of a CVVL system is shown in U.S. Pat. No. 5,937,809 to Pierik et al. The CVVL system of U.S. Pat. No. 5,937,809 is also a lost motion arrangement; however, unlike U.S. Pat. No. 6,988,473 discussed above, the CVVL system of U.S. Pat. No. 5,937,809 is arranged to minimize or eliminate the delay in opening of the combustion valve.

What is needed is a valve train system which minimizes or eliminates one or more of the shortcomings as set forth above.

SUMMARY OF THE INVENTION

Briefly described, a valve train system is provided for opening and closing a combustion valve of an internal combustion engine. The valve train system includes a camshaft that is rotatable about a camshaft axis and includes a camshaft lobe. The valve train system also includes a control shaft that is rotatable about a control shaft axis and includes a control shaft slot eccentric to the control shaft axis. An input rocker is configured to engage the camshaft lobe and has a rocker slot. An output rocker is configured to engage a valve actuation member which is engaged with the combustion valve. A rocker pivot shaft has a rocker pivot shaft axis and is fixed to the output rocker and extends through both the control shaft slot and the rocker slot. Rotation of the camshaft causes the input rocker and the output rocker to pivot about the rocker pivot shaft axis and rotation of the control shaft causes the rocker pivot shaft axis to change position, thereby changing the magnitude that the input rocker and the output rocker pivot about the rocker pivot shaft axis and also changing the magnitude of opening the combustion valve.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
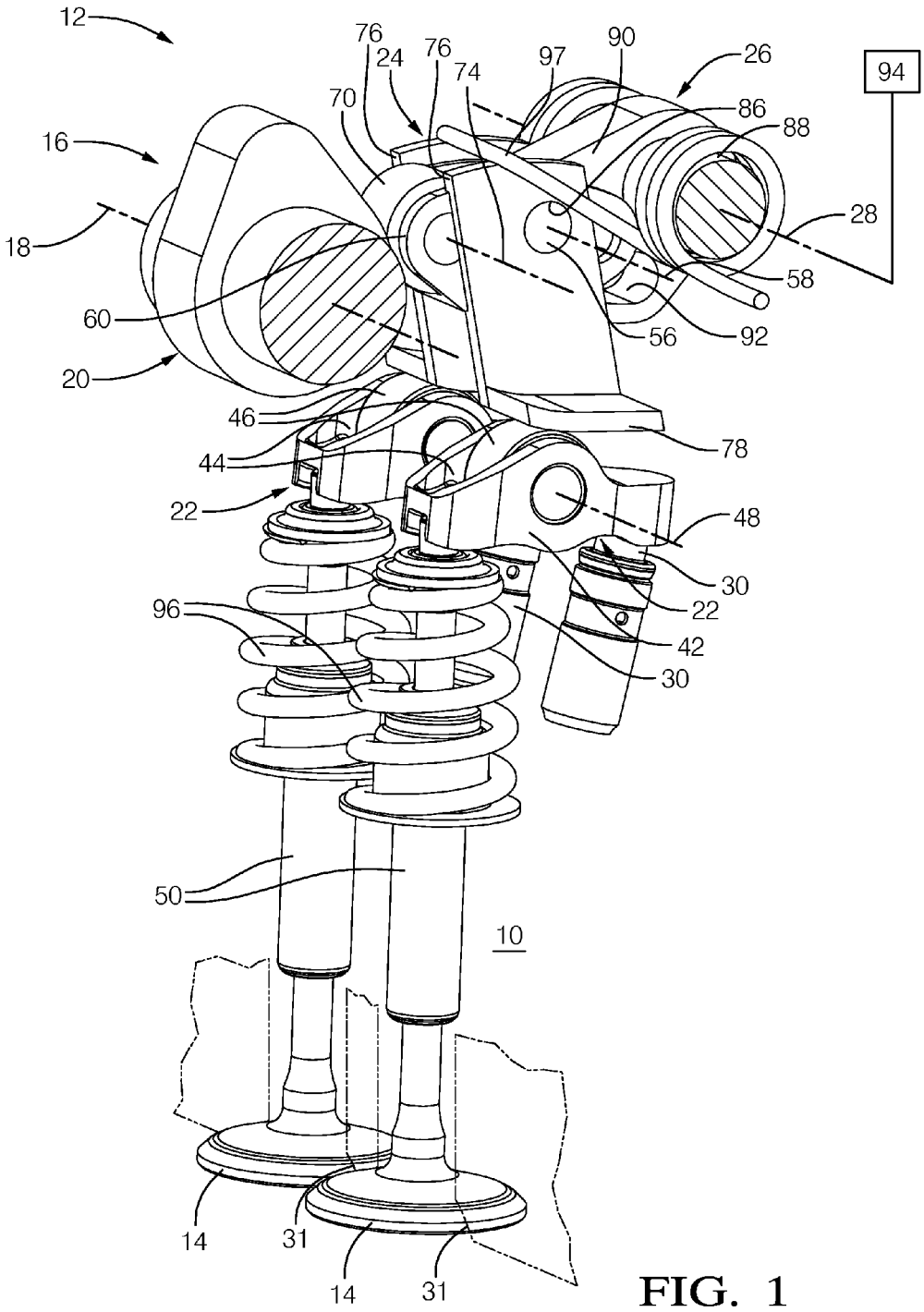
FIG. 1 is an isometric view of a valve train system in accordance with the present invention.

In accordance with a preferred embodiment of this invention and referring to FIGS. 1-7, internal combustion engine 10 is shown which includes a valve train system 12 for variably opening and closing a pair of combustion valves 14. Combustion valves 14 may be intake valves which introduce a charge of air or air and fuel into a combustion chamber (not shown) of internal combustion engine 10. Alternatively, combustion valves 14 may be exhaust valves which allow exhaust constituents to be expelled from the combustion chamber of internal combustion engine 10. Valve train system 12 includes a camshaft 16 which rotates about a camshaft axis 18 and includes a camshaft lobe 20, a pair of valve actuation members illustrated as roller finger followers 22 that are each engaged with a respective combustion valve 14, a rocker assembly 24 engaged with camshaft lobe 20 and roller finger followers 22 for translating motion from camshaft lobe 20 to roller finger followers 22, and a control shaft 26 rotatable about a control shaft axis 28 for varying the motion translated from camshaft lobe 20 to roller finger followers 22. As camshaft 16 and camshaft lobe 20 rotate about camshaft axis 18 which is in a fixed location, camshaft lobe 20 causes rocker assembly 24 to pivot in a reciprocating manner which in turn causes roller finger followers 22 to pivot in a reciprocating manner about respective hydraulic lash adjusters 30 of internal combustion engine 10. Combustion valves 14 move between an open position and a closed position as roller finger followers 22 pivot about hydraulic lash adjusters 30. The extent to which combustion valves 14 are able to be opened, i.e. the distance combustion valves 14 are lifted from respective valve seats 31, is able to be varied by changing the geometry of rocker assembly 24 by rotating control shaft 26 about control shaft axis 28. Unlike U.S. Pat. Nos. 5,937,809 and 6,988,473 discussed in the Background of Invention Section which are considered lost motion arrangements because some motion of the rocker assembly is not transferred to the combustion valve, valve train system 12 is not a lost motion arrangement because all of the motion of rocker assembly 24 is transferred to combustion valves 14. Valve train system 12 may instead be considered a lost rotation arrangement because the amount of rotation of rocker assembly 24 is varied as will be described in greater detail later.

Camshaft lobe 20 includes a base circle portion 32 which is a constant distance from camshaft axis 18 and a valve lift portion which is not a constant distance from camshaft axis 18 and which is a greater distance from camshaft axis 18 than base circle portion 32. The valve lift portion includes a valve opening portion 36, a nose 38, and a valve closing portion 40. While base circle portion 32 engages rocker assembly 24, combustion valves 14 remain closed against valve seats 31. As camshaft lobe 20 rotates clockwise about camshaft axis 18 which is fixed in position, rocker assembly 24 will first engage valve opening portion 36 after moving off of base circle portion 32 which causes combustion valves 14 to open, i.e. move away from respective valve seats 31. Combustion valves 14 continue to open until camshaft lobe 20 has rotated sufficiently far to cause nose 38 to engage rocker assembly 24. Nose 38 is the location on camshaft lobe 20 that is furthest from camshaft axis 18, and consequently combustion valves 14 reach their peak lift, i.e. the maximum distance from respective valve seats 31 for a given rotational position of control shaft 26, when nose 38 engages rocker assembly 24. As camshaft lobe 20 continues to rotate clockwise, rocker assembly 24 will engage valve closing portion 40 after moving away from nose 38 which causes combustion valves 14 to begin to close, i.e. move toward respective valve seats 31. Combustion valves 14 continue to close until camshaft lobe 20 has rotated sufficiently far to cause base circle portion 32 to again engage rocker assembly 24, thereby seating combustion valves 14 against their respective valve seats 31.

Roller finger followers 22 each include a roller finger follower body 42 defining a roller aperture 44. A roller finger follower roller 46 is positioned within roller aperture 44 and configured to rotate about a roller finger follower axis 48 which is substantially perpendicular to camshaft axis 18 and control shaft axis 28. One end of roller finger follower body 42 is configured to engage and pivot about hydraulic lash adjuster 30 while the other end of roller finger follower body 42 is configured to engage a valve stem 50 of combustion valve 14.

Figures 2, 3:
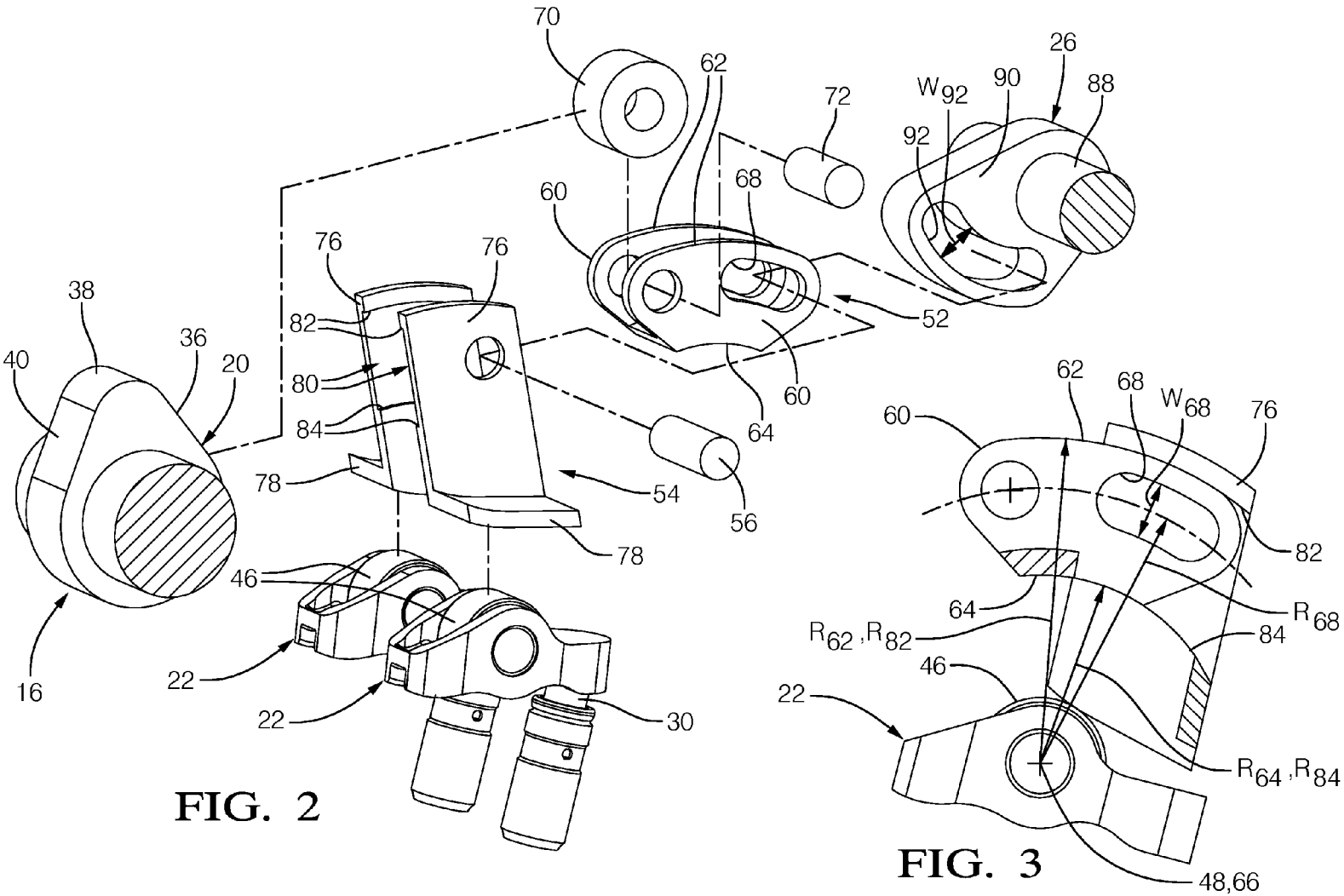
FIG. 2 is an isometric exploded view of a rocker assembly and a control shaft of the valve train system of FIG. 1.
FIG. 3 is a cross-sectional view of the rocker assembly of the valve train system of FIG. 1.

With continued reference to FIGS. 1-7, but now with emphasis on FIGS. 2 and 3, rocker assembly 24 includes an input rocker 52 which engages camshaft lobe 20, an output rocker 54 which engages roller finger followers 22, and a rocker pivot shaft 56 having a rocker pivot shaft axis 58. Rocker pivot shaft 56 engages output rocker 54 and control shaft 26 in order to change the relative position of output rocker 54 to input rocker 52 as control shaft 26 is rotated about control shaft axis 28 as will be discussed in greater detail later.

Input rocker 52 includes a pair of opposing input rocker plates 60 which are spaced apart and substantially parallel to each other such that input rocker plates 60 are minor images of each other. Each input rocker plate 60 is defined by an input rocker first arcuate edge 62 having a radius $R_{62}$ and an input rocker second arcuate edge 64 having a radius $R_{64}$ such that $R_{62}$ and $R_{64}$ share a common center 66 when assembled. Input rocker plates 60 may be linked together as shown to move together as a single unit. Each input rocker plate 60 defines a rocker slot 68 therethrough. Rocker slot 68 is arcuate in shape with a center that is a constant radius $R_{68}$ and rocker slot 68 has a width $W_{68}$ that is substantially the same as the diameter of rocker pivot shaft 56. The end of input rocker 52 that is proximal to camshaft 16 includes an input rocker roller 70 that is positioned between input rocker plates 60 such that a portion of input rocker roller 70 extends radially outward from input rocker 52. Input rocker roller 70 is supported by an input rocker roller axle 72 having an input rocker roller axis 74 that is parallel to camshaft axis 18 and control shaft axis 28 such that input rocker roller 70 rotates about input rocker roller axis 74. Each end of input rocker roller axle 72 is fixed to a respective input rocker plate 60. Input rocker roller 70 is engaged with camshaft lobe 20.

Output rocker 54 includes a pair of opposing output rocker plates 76 which are spaced apart and substantially parallel to each other such that output rocker plates 76 are minor images of each other. Output rocker plates 76 may be linked together as shown to move together as a single unit. One end of each output rocker plate 76 includes an output cam 78 which extends laterally outward from output rocker plates 76 to engage a respective roller finger follower roller 46. Each output rocker plate 76 defines an output rocker recess 80 that is sized and shaped to closely receive a respective input rocker plate 60 such that each input rocker plate 60 is able to slide within its respective output rocker recess 80. Consequently, each output rocker recess 80 is defined by a first arcuate recess edge 82 having a radius $R_{82}$ that substantially matches radius $R_{62}$ of input rocker first arcuate edge 62. Each output rocker recess 80 is also defined by a second arcuate recess edge 84 having a radius $R_{84}$ that substantially matches radius $R_{64}$ of input rocker second arcuate edge 64. Radius $R_{82}$ and radius $R_{84}$ are centered about common center 66 when input rocker 52 and output rocker 54 are assembled. Each output rocker plate 76 defines an output rocker plate aperture 86 therethrough such that output rocker plate aperture 86 opens up into output rocker recess 80 and such that output rocker plate aperture 86 is aligned with rocker slots 68. Output rocker plate apertures 86 are sized to closely receive rocker pivot shaft 56, for example, in a press fit relationship in order to secure rocker pivot shaft 56 to output rocker plates 76.

Figure 5:
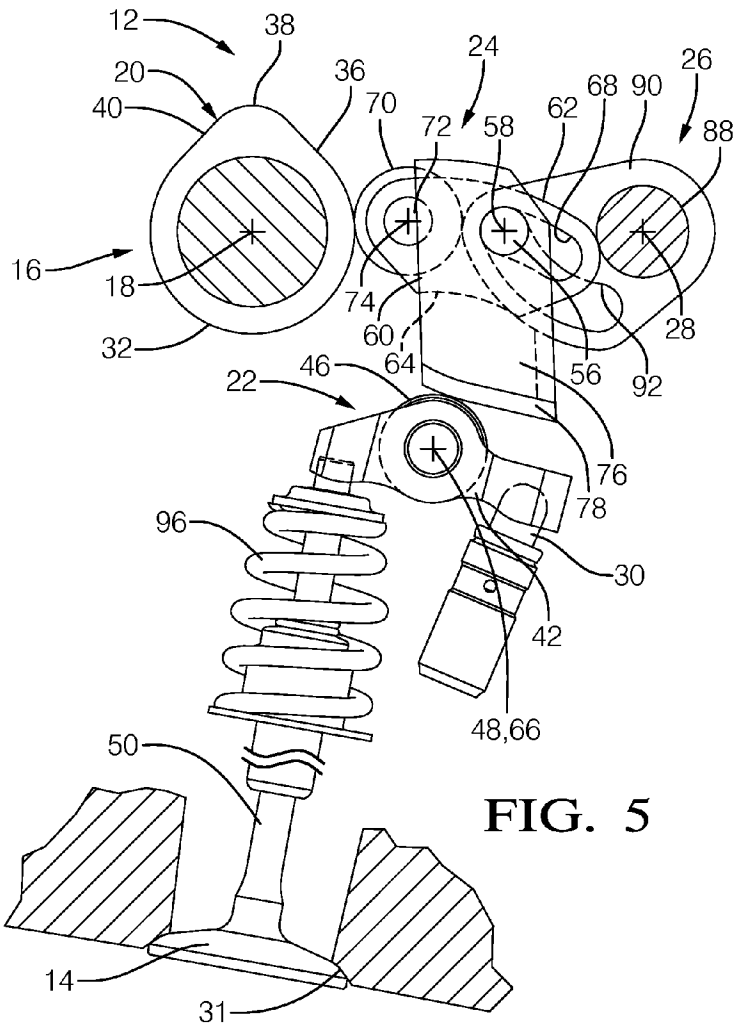
FIG. 5 is the side view of FIG. 4 now showing the control shaft rotated to an extreme counterclockwise position.
Figure 4:
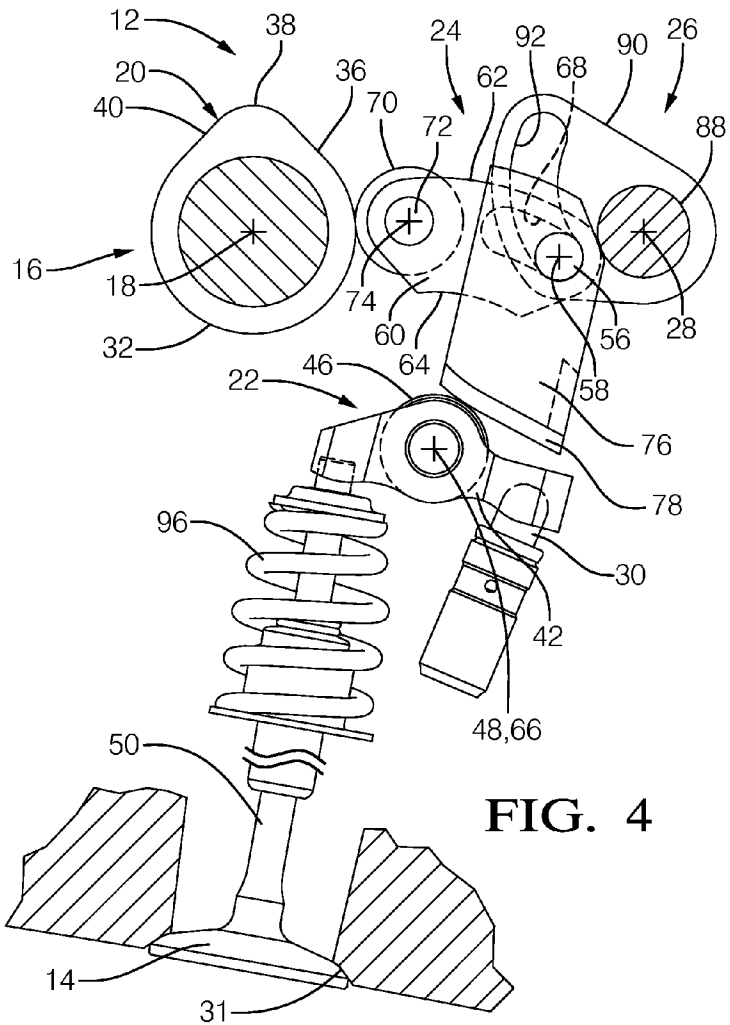
FIG. 4 is a side view of the valve train system of FIG. 1 showing a control shaft rotated to an extreme clockwise position and a rocker assembly engaged with a base circle of a camshaft lobe.
Figure 7:
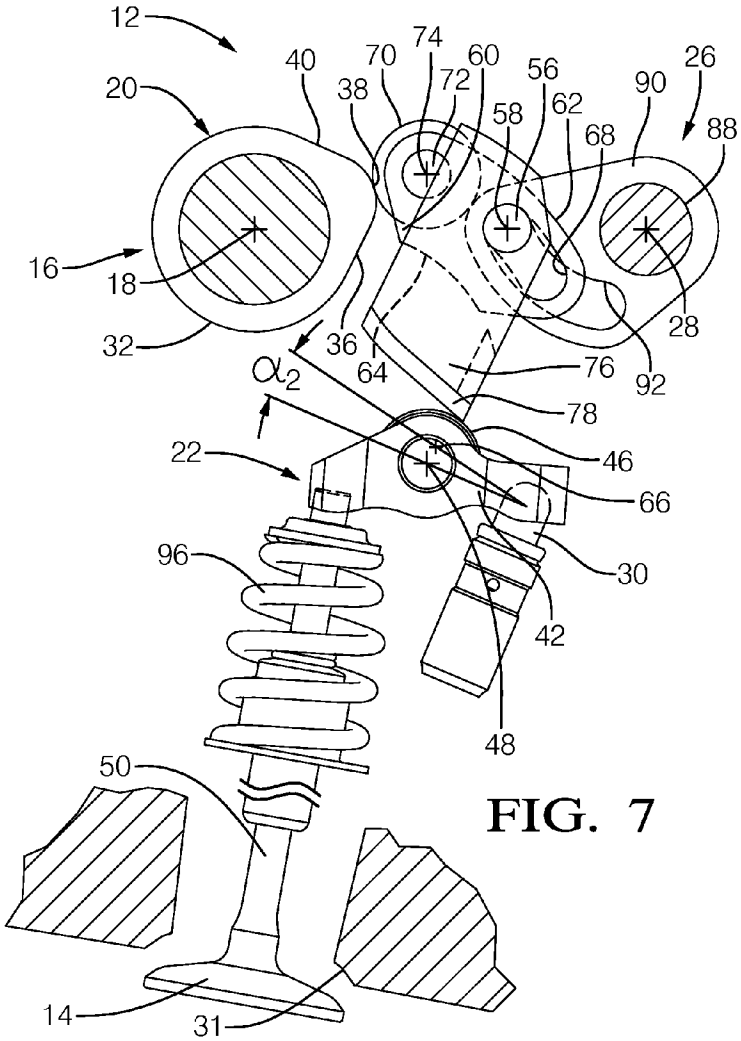
FIG. 7 is the side view of FIG. 6 now showing the control shaft rotated to an extreme counterclockwise position.
Figure 6:
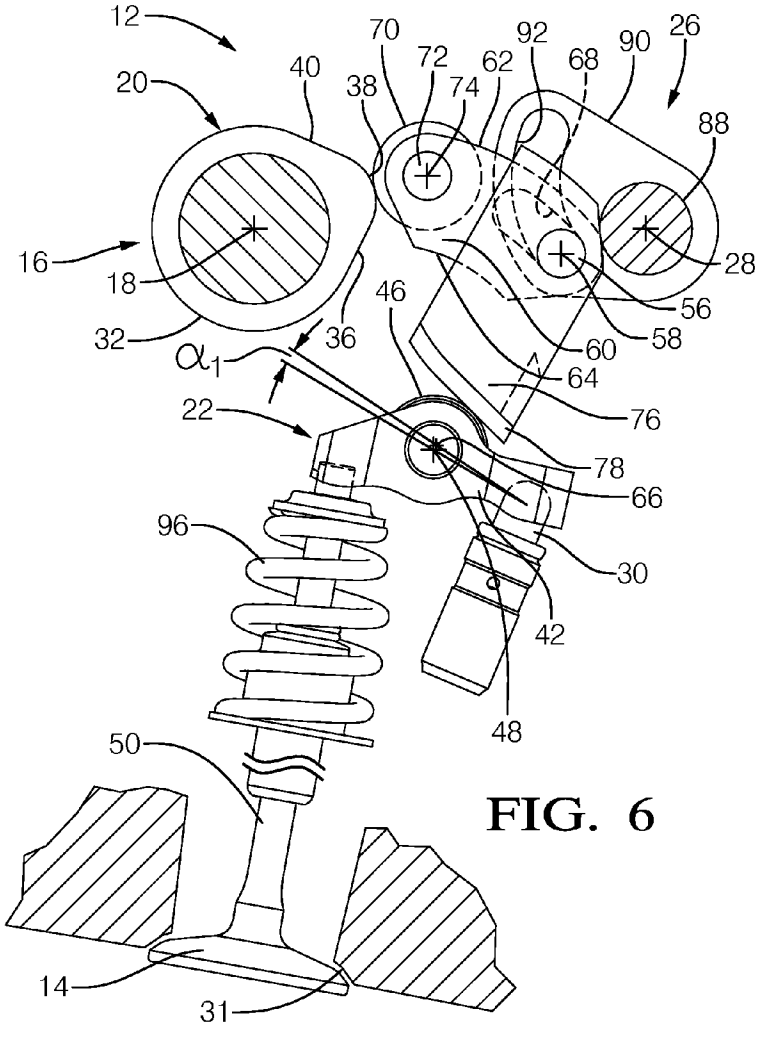
FIG. 6 is the side view of FIG. 4 now showing the rocker assembly engaged with a nose of the camshaft lobe.

Control shaft 26 includes a cylindrical portion 88 which is centered about control shaft axis 28. Control shaft 26 also includes a control shaft body 90 which extends eccentrically outward from cylindrical portion 88. Control shaft body 90 defines a control shaft slot 92 therethrough which is eccentric to control shaft axis 28. Control shaft slot 92 has a width $W_{92}$ that is substantially the same as the diameter of rocker pivot shaft 56 and width $W_{68}$ of rocker slot 68. As shown, the center of control shaft slot 92 takes the shape of a spiral, however, it should be understood that the center of control shaft slot 92 may take other forms, for example, straight or constant radius. Regardless of the shape that the center of control shaft slot 92 takes, the center of control shaft slot 92 preferably is not a constant distance from control shaft axis 28. Control shaft body 90 is sized to fit between input rocker plates 60 such that control shaft slot 92 is aligned with rocker slots 68 and output rocker plate apertures 86 which allows rocker pivot shaft 56 to extend through output rocker plate apertures 86, rocker slots 68 and control shaft slot 92. Control shaft 26 is attached to a rotary actuator 94 (only shown in FIG. 1) which is able to rotate control shaft 26 both clockwise and counterclockwise about control shaft axis 28 from a minimum lift position when control shaft 26 is rotated to an extreme clockwise position as shown in FIGS. 4 and 6, to a maximum lift position when control shaft 26 is rotated to an extreme counterclockwise position as shown in FIGS. 5 and 7. It should be noted that rotary actuator 94 may stop control shaft 26 at any predetermined position between the extreme clockwise position and the extreme counterclockwise position to provide a valve lift that is between the minimum valve lift and the maximum valve lift. Rotary actuator 94 may be, for example only, electrically driven and may or may not include a gear reduction mechanism.

With reference to FIG. 4 which shows control shaft 26 rotated to the extreme clockwise position and to FIG. 5 which shows control shaft 26 rotated to the extreme counterclockwise position, the effect of rotation of control shaft 26 will be described as input rocker roller 70 being engaged with camshaft lobe 20 on base circle portion 32 which results in combustion valve 14 being closed. As can be seen, an outside surface of each input rocker plate 60 rides against cylindrical portion 88 of control shaft 26 throughout the range of motion of control shaft 26. Also as can be seen, the distance from rocker pivot shaft axis 58 to input rocker roller axis 74 decreases as control shaft 26 is rotated from the extreme clockwise position to the extreme counterclockwise position while the distance from rocker pivot shaft axis 58 to roller finger follower axis 48 remains constant throughout the range of motion of control shaft 26. It is also important to note that common center 66 lies on roller finger follower axis 48 throughout the range of motion of control shaft 26 which results in input rocker 52 remaining stationary throughout the range of motion of control shaft 26 while input rocker roller 70 is engaged with camshaft lobe 20 on base circle portion 32. As control shaft 26 moves through its range of motion from the extreme clockwise position to the extreme counterclockwise position, rocker pivot shaft 56 is slides within control shaft slot 92 and is urged closer to input rocker roller axle 72 as a result of the center of control shaft slot 92 being a non-constant distance from control shaft axis 28. As rocker pivot shaft 56 is urged closer to input rocker roller axle 72, output rocker plates 76 are moved with rocker pivot shaft 56 because rocker pivot shaft 56 is fixed to output rocker plates 76. As output rocker plates 76 are moved with rocker pivot shaft 56, output rocker plates 76 are guided by input rocker plates 60 which fit within output rocker recesses 80; however, input rocker 52 remains stationary because input rocker first arcuate edge 62, input rocker second arcuate edge 64, first arcuate recess edge 82, second arcuate recess edge 84, and the center of rocker slot 68 all have a respective constant radius with a center at common center 66 which lies on roller finger follower axis 48. It is important to note that as output rocker plates 76 are moved as a result of rotation of control shaft 26, the angle at which output cams 78 of output rocker plates 76 engages roller finger follower roller 46 changes; however, the point on output cams 78 which engage roller finger follower rollers 46 remains constant throughout the range of motion of control shaft 26.

With reference to FIG. 6 which shows control shaft 26 rotated to the extreme clockwise position and to FIG. 7 which shows control shaft 26 rotated to the extreme counterclockwise position, the effect of rotation of control shaft 26 will be described as input rocker roller 70 being engaged with camshaft lobe 20 on nose 38 which results in combustion valve 14 being open. As the valve lift portion of camshaft lobe 20 engages input rocker roller 70, rocker assembly 24 is caused to rotate or pivot about rocker pivot shaft axis 58. This pivoting of rocker assembly 24 about rocker pivot shaft axis 58 causes output cams 78 to push on roller finger follower rollers 46. Since one end of roller finger followers 22 is rigidly supported by hydraulic lash adjusters 30, output cams 78 cause roller finger followers 22 to pivot about hydraulic lash adjusters 30, thereby compressing valve springs 96 and causing combustion valves 14 to be open. As shown in FIGS. 5 and 6, the magnitude to which combustion valves 14 are opened is affected by the rotational position of control shaft 26. As the distance from rocker pivot shaft axis 58 to input rocker roller axis 74 increases, the magnitude that input rocker 52 and output rocker 54 rotate is decreased, thereby decreasing the magnitude that roller finger followers 22 pivot about hydraulic lash adjusters 30 and also decreasing the magnitude that combustion valves 14 are opened. Since decreasing the magnitude that combustion valves 14 are opened is caused by decreasing the magnitude of rotation that input rocker 52 and output rocker 54 rotate, valve train system 12 is considered a lost rotation arrangement. FIG. 6 shows control shaft 26 rotated to the extreme clockwise position (maximum distance from rocker pivot shaft axis 58 to input rocker roller axis 74) which causes roller finger followers 22 to pivot about hydraulic lash adjusters 30 an angle $\alpha_1$ while FIG. 7 shows control shaft 26 rotated to the extreme counterclockwise (minimum distance from rocker pivot shaft axis 58 to input rocker roller axis 74) position which causes roller finger followers 22 to pivot about hydraulic lash adjusters 30 an angle $\alpha_2$ which is greater than $\alpha_1$, for example, by about 15°. As can be seen, combustion valve 14 is lifted from valve seat 31 a lesser magnitude in FIG. 6 than in FIG. 7.

Figure 8:
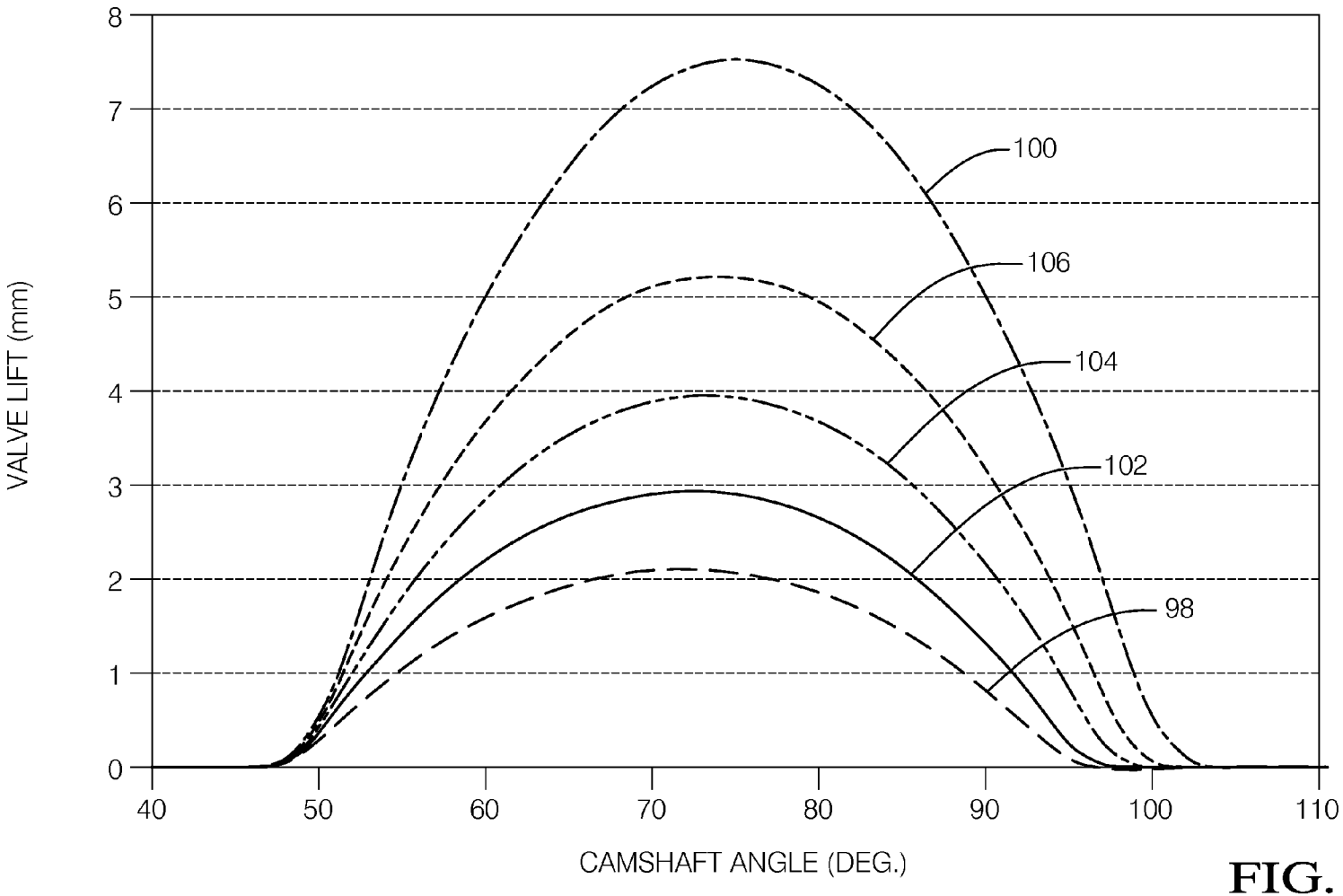
FIG. 8 is a plot of representative valve lifts produced by the valve train system of FIG. 1.

Reference will now be made to FIG. 8 which shows a plot of representative valve lifts produced by valve train system 12. In FIG. 8, trace 98 represents the valve lift of combustion valves 14 as camshaft lobe 20 rotates about camshaft axis 18 when control shaft 26 is positioned at the extreme clockwise position as shown in FIG. 6 while trace 100 represents the valve lift of combustion valves 14 as camshaft lobe 20 rotates about camshaft axis 18 when control shaft 26 is positioned at the extreme counterclockwise position as shown in FIG. 7. FIG. 8 also includes traces 102, 104, and 106 which illustrate lifts of combustion valves 14 as camshaft lobe 20 rotates about camshaft axis 18 when control shaft 26 is positioned at representative locations between the extreme clockwise position and the extreme counterclockwise position. As can be seen by traces 98, 100, 102, 104, 106; combustion valves 14 begin to open at the same angular position of camshaft lobe 20 regardless of the rotational position of control shaft 26.

A rocker spring 97 (shown only in FIG. 1) may be provided in order to ensure that input rocker roller 70 maintains contact with camshaft lobe 20 at all times, particularly when input rocker roller 70 transitions from nose 38 to valve closing portion 40 when rocker assembly 24 has an inertial tendency to continue to rotate clockwise. Rocker spring 97 may be a torsion spring as shown that has coils that surround cylindrical portion 88 of control shaft 26. One arm of rocker spring 97 is grounded to internal combustion engine 10 while a second arm of rocker spring 97 abuts the top of output rocker 54 to urge rocker assembly 24 in a counterclockwise direction. When input rocker roller 70 transitions from nose 38 to valve closing portion 40, the direction of rotation of rocker assembly 24 needs to reverse from clockwise to counterclockwise. Rocker spring 97 acts to resist the inertial tendency of rocker assembly 24 to continue to rotate clockwise when input rocker roller 70 transitions from nose 38 to valve closing portion 40.

While rocker assembly 24 has been described as transferring motion from camshaft lobe 20 to two combustion valves 14, it should now be understood that rocker assembly 24 may alternatively be configured to transfer motion from camshaft lobe 20 to only a single combustion valve 14 while maintaining the spirit of the invention.

While this invention has been described in terms of preferred embodiments thereof, it is not intended to be so limited, but rather only to the extent set forth in the claims that follow.

I claim:

1. A valve train system for opening and closing a combustion valve of an internal combustion engine, said valve train system comprising:

a camshaft rotatable about a camshaft axis and having a camshaft lobe;

a control shaft rotatable about a control shaft axis and having a control shaft slot eccentric to said control shaft axis;

an input rocker configured to engage said camshaft lobe and having a rocker slot;

an output rocker configured to engage a valve actuation member which is engaged with said combustion valve; and a rocker pivot shaft having a rocker pivot shaft axis, said rocker pivot shaft being fixed to said output rocker and extending through both said control shaft slot and said rocker slot;

wherein rotation of said camshaft causes said input rocker and said output rocker to pivot about said rocker pivot shaft axis;

and wherein rotation of said control shaft causes said rocker pivot shaft axis to change position, thereby changing the magnitude that said input rocker and said output rocker pivot about said rocker pivot shaft axis and also changing the magnitude of opening said combustion valve.

2. A valve train system as in claim 1 wherein said valve actuation member is a roller finger follower and said output rocker engages a roller of said roller finger follower that is rotatable about a roller finger follower axis and the distance from said roller finger follower axis to said rocker pivot shaft axis does not change with rotation of said control shaft.

3. A valve train system as in claim 1 wherein said output rocker includes an output rocker recess which receives said input rocker therein.

4. A valve train system as in claim 3 wherein rotation of said control shaft causes said output rocker to slide over said input rocker such that said output rocker is guided by said input rocker within said output rocker recess.

5. A valve train system as in claim 3 wherein said output rocker recess is defined by a first arc and a second arc having a common center.

6. A valve train system as in claim 5 wherein said valve actuation member is a roller finger follower and said output rocker engages a roller of said roller finger follower that is rotatable about a roller finger follower axis that passes through said common center.

7. A valve train system as in claim 1 wherein said control shaft slot is a spiral.

8. A valve train system as in claim 1 wherein said rocker slot is arc-shaped.

9. A valve train system as in claim 8 wherein the center of said rocker slot has a constant radius.

10. A valve train system as in claim 9 wherein said valve actuation member is a roller finger follower and said output rocker engages a roller of said roller finger follower that is rotatable about a roller finger follower axis and wherein said constant radius is centered about said roller finger follower axis.

11. A valve train system as in claim 1 wherein rotation of said control shaft does not cause said input rocker to move.

12. A valve train system as in claim 1 wherein rotation of said control shaft does not cause said valve actuation member to engage said output rocker at a different location on said output rocker.

13. A valve train system as in claim 1 wherein said control shaft includes a cylindrical portion centered about said control shaft axis and an outside surface of said input rocker rides against said cylindrical portion when said combustion valve is closed.

14. A valve train system as in claim 1 wherein said output rocker includes a pair of opposing output rocker plates and each of said output rocker plates includes an output rocker recess.

15. A valve train system as in claim 14 wherein said input rocker is positioned between said output rocker plates.

16. A valve train system as in claim 15 wherein:

said input rocker includes a pair of opposing input rocker plates; and said rocker slot is a first rocker slot in one of said input rocker plates and the other of said input rocker plates includes a second rocker slot.

17. A valve train system as in claim 16 wherein one of said input rocker plates is received within said output rocker recess of one of said output rocker plates and the other of said input rocker plates is received within said output rocker recess of the other of said output rocker plates.

18. A valve train system as in claim 16 wherein rotation of said control shaft causes each of said output rocker plates to slide over a respective one of said input rocker plates such that said output rocker plates are guided by a respective one of said input rocker plates within a respective one of said output rocker recesses.

19. A valve train system as in claim 16 wherein said control shaft slot is located in a control shaft body that is eccentric to said control shaft and said control shaft body is located between said input rocker plates.

20. A valve train system as in claim 16 wherein said rocker pivot shaft extends through said second rocker slot.

21. A valve train system for opening and closing a combustion valve of an internal combustion engine, said valve train system comprising:

a camshaft rotatable about a camshaft axis and having a camshaft lobe;

a control shaft rotatable about a control shaft axis and having a control shaft slot eccentric to said control shaft axis;

an input rocker configured to engage said camshaft lobe;

an output rocker configured to engage one of a valve actuation member and said combustion valve for opening and closing said combustion valve, wherein one of said input rocker and said output rocker includes a rocker slot; and a rocker pivot shaft having a rocker pivot shaft axis, said rocker pivot shaft being fixed to one of said input rocker and said output rocker and extending through both said control shaft slot and said rocker slot;

wherein rotation of said camshaft causes said input rocker and said output rocker to pivot about said rocker pivot shaft axis;

and wherein rotation of said control shaft causes said rocker pivot shaft axis to change position, thereby changing the magnitude that said input rocker and said output rocker pivot about said rocker pivot shaft axis and also changing the magnitude of opening said combustion valve.

22. A valve train system as in claim 21 wherein said input rocker includes said rocker slot.

23. A valve train system as in claim 22 wherein said rocker pivot shaft is fixed to said output rocker.

* * * * *